US007954180B2

(12) United States Patent
Cervi

(10) Patent No.: US 7,954,180 B2
(45) Date of Patent: Jun. 7, 2011

(54) TOILET TRANSFER SYSTEMS AND METHODS

(76) Inventor: Rene Cervi, Ft. Mohave, AZ (US)

( * ) Notice: Subject to any disclaimer, the term of this patent is extended or adjusted under 35 U.S.C. 154(b) by 0 days.

(21) Appl. No.: 12/729,862

(22) Filed: Mar. 23, 2010

(65) Prior Publication Data

US 2010/0175184 A1 Jul. 15, 2010

Related U.S. Application Data

(63) Continuation of application No. 11/303,413, filed on Dec. 16, 2005, now abandoned.

(51) Int. Cl.
*E03D 11/00* (2006.01)

(52) U.S. Cl. ..... 4/254; 4/599; 4/571.1

(58) Field of Classification Search ..... 4/245, 254, 4/555, 547, 559, 577.1, 578.1, 483, 300.3, 4/661, 599; 5/81.1, 81.1 R; 297/DIG. 4
See application file for complete search history.

(56) References Cited

U.S. PATENT DOCUMENTS

| | | | | |
|---|---|---|---|---|
| 2,877,830 | A * | 3/1959 | Smith | 297/461 |
| 4,287,619 | A | 9/1981 | Brewer et al. | |
| 4,472,844 | A * | 9/1984 | Mace | 4/579 |
| 5,090,072 | A | 2/1992 | Gray | |
| 5,687,431 | A | 11/1997 | Garrett | |
| 6,036,216 | A | 3/2000 | Osborn | |
| 6,076,200 | A | 6/2000 | Yeung | |
| 6,332,230 | B1 * | 12/2001 | Chang | 4/577.1 |
| 6,721,966 | B2 | 4/2004 | Costonde | |
| 6,745,417 | B2 | 6/2004 | Sumino | |
| 2002/0166166 | A1 * | 11/2002 | Costonde | 4/661 |
| 2006/0179558 | A1 | 8/2006 | Dupuis | |

OTHER PUBLICATIONS

Website ordering page print out of Rehabilitation & Medical Supplies for an "Assure Transfer Board, Small or Large," located at http://www.rehabmart.com/product/5491.htm in 1 page.

International Search Report and Written Opinion of corresponding PCT Application No. PCT/US06/46629, date of mailing Oct. 23, 2007.

* cited by examiner

*Primary Examiner* — Gregory L Huson
*Assistant Examiner* — Karen Younkins
(74) *Attorney, Agent, or Firm* — Caesar, Rivise, Bernstein, Cohen & Pokotilow, Ltd.

(57) ABSTRACT

A toilet transfer system is described for assisting a person to transfer between a wheelchair and a toilet. The system comprises a base unit that is attached to a toilet and that may be supported by one or more legs. The system further comprises a transfer board that is rotatably coupled to the base unit, allowing the transfer board to be positioned in a variety of positions without need to detach the toilet transfer system from the toilet. The transfer board may be pointed forward to allow the wheelchair to be positioned for transfer, pointed towards the wheelchair for transfer, and pointed back for compact storage between transfers and for normal use of the toilet. A coupling system accommodates height differentials between the toilet and the wheelchair, and allows the transfer board to become lifted up off the base unit and/or rotated without becoming misaligned from the base unit.

20 Claims, 6 Drawing Sheets

TOILET TRANSFER SYSTEMS AND METHODS

BACKGROUND OF THE INVENTION

1. Field of the Invention

The present invention is directed to systems and methods for assisting in the transfer of handicapped persons, and, in particular, for assisting in the transfer of persons between a wheelchair and a toilet.

2. Description of Related Art

Currently, a disabled person who uses a wheelchair and cannot stand is typically physically lifted on and off of a toilet by a caregiver. This method of transferring the disabled person can be dangerous to the caregiver, who can be injured while performing such a heavy lifting task. Furthermore, it can be dangerous to the disabled person, who could suffer bodily injury if grabbed or pulled during transfer. An unsuccessful transfer may result in injury to both parties due to a fall.

Transfer boards, commonly long and rectangular, are frequently used to transfer disabled persons between their wheelchairs and other surfaces, especially surfaces that are generally flat and that can therefore stably support the transfer board. However, such transfer boards are not suitable for transfer between a wheelchair and a toilet for a number of reasons.

For example, long rectangular transfer boards that cannot anchor to the toilet are prone to slipping off the hard, slick surface of the toilet while in use, causing a very dangerous situation. Boards with a hook at one end may not easily accommodate height differentials that frequently exist between wheelchairs and toilets and may exert undue pressure on the toilet bowl and/or may become easily disengaged during set-up and use. Some transfer boards that are contoured and that sit onto a toilet at a first end and are supported on the wheelchair at a second end are difficult to simultaneously position on the toilet and position under the person for transfer. Furthermore, a toilet transfer system that must be removed and replaced between uses, possibly requiring the intervention of a caregiver in order to be properly secured, may be of diminished usefulness to a disabled person who does not have or want constant assistance.

A transfer system that takes up an excessive amount of space in a bathroom, which is typically a small room, may make it uncomfortable for another person to sit on the toilet seat normally. Similarly, toilet transfer systems that do not allow for easy alignment of the wheelchair prior to transfer are of diminished value to disabled people attempting to accomplish the toilet transfer task independently. Finally, toilet transfer systems that are not easily portable make it difficult for a disables person to use the transfer system in multiple locations.

BRIEF SUMMARY OF THE INVENTION

A toilet transfer system is disclosed herein that allows a wheelchair-dependent person to transfer to a toilet with or without assistance, thereby increasing the person's independence and associated sense of well-being. The toilet transfer system may be left in place after being initially set up, without disturbing the normal configuration and usability of the toilet seat by non-handicapped persons. Embodiments of the toilet transfer system may be easily moved by the handicapped person or caregiver between three useful positions without the need to dismantle the system: a storage position greatly decreases floor space taken up by the toilet transfer system between uses, a set-up position allows a wheelchair-dependent person to easily and independently maneuver the wheelchair into a suitable position for safe transfer without requiring more space than is commonly available in a handicapped-equipped or normal oversized home bathroom, and an in-use position allows the handicapped person to securely transfer to and from the toilet. A coupling system advantageously allows the toilet transfer system to accommodate a variety of height differentials between the toilet and the wheelchair without becoming unstable or unaligned, or placing undue pressure on the toilet bowl. Furthermore, the toilet transfer system may be easily and compactly dismantled for portable use in other locations.

An embodiment of an apparatus for assisting a person to transfer between a wheelchair and a toilet is described. The apparatus includes: a base unit that comprises a coupler-receiving hole and that attaches to the toilet; a transfer board; and a coupling mechanism that rotatably attaches the transfer board to the base unit. The coupling mechanism further comprises: a coupling mount that is attached to the transfer board; and a guide post that joins at a first end to the coupling mount with a ball joint, and that extends from the coupling mount through the coupler-receiving hole in the base unit, wherein an end cap of the guide posts restrains the coupling mechanism from becoming detached from the base unit. The coupling mechanism allows the transfer board to be rotated about a plurality of axes without becoming detached from the base unit.

An embodiment of a device for assisting in the transfer of a person from a wheelchair to a toilet is described. The device comprises a base unit positioned between the wheelchair and the toilet. The device also comprises a transfer member having a surface along which the person can slide between the wheelchair and the toilet. The transfer member has a first end and has a second end which rests on the wheelchair The device further comprises a joint assembly for connecting the first end of the transfer member to the base unit, the joint assembly permitting rotation of the transfer member about the base unit along two or more axes.

An embodiment of a method of assisting a person to transfer between a wheelchair and a toilet is described. The method includes: attaching a base unit to the toilet; attaching a first end of a transfer board to the base unit, and resting a second end of the transfer board on the wheelchair; and sliding the person from the wheelchair to the toilet on the transfer board.

An embodiment of an apparatus for assisting a person to transfer between a wheelchair and a toilet is described. The apparatus comprises: a base unit comprising a platform and a bracket system, wherein the bracket system secures the base unit to the toilet; and a transfer board having a first end supported on and rotatably coupled to the base unit, the transfer board having a second end supported on a wheelchair.

An embodiment of a system for assisting a person to transfer between a wheelchair and a toilet is described. The system comprises: means for attaching a base unit to the toilet; and means for coupling a first end of a transfer board to the base unit, such that a second end of the transfer board may rest on the wheelchair.

Still further advantages will become apparent from a consideration of the ensuing description. Neither this summary nor the following detailed description defines the invention. The invention is defined by the claims.

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements.

DETAILED DESCRIPTION OF THE INVENTION

The toilet transfer system described herein allows a person who cannot stand unassisted to move between a wheelchair and a toilet, or between a toilet and a wheelchair, either unassisted or with assistance.

Figure 1:
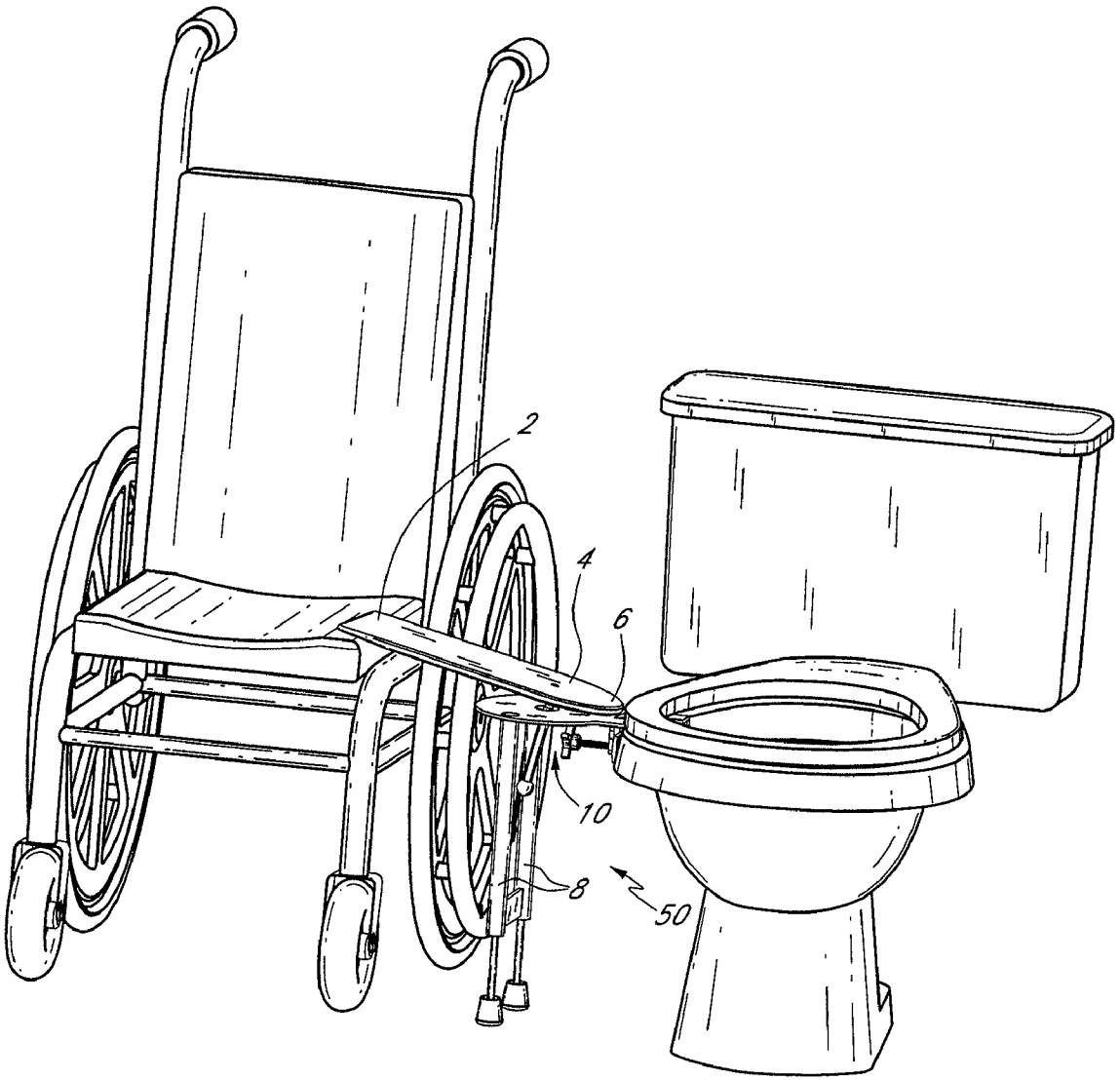
FIG. 1 depicts one embodiment of a toilet transfer system installed on a toilet and ready for use.

FIG. 1 depicts one embodiment of a toilet transfer system 50 installed on a toilet and in position for use. As depicted in FIG. 1, the toilet transfer system comprises a base unit 10 that attaches to the toilet, as will be described in greater detail with reference to FIGS. 2 and 3 to follow, and that rotatably supports a transfer board 4. The base unit 10 may be supported, at least in part, by one or more adjustable-height legs 8, which provide additional support and stability to the base unit 10, when the toilet transfer system is in use, partially supporting the weight of a person transferring between a wheelchair and a toilet.

The transfer board 4 is coupled at a coupled end 6 to the base unit 10, as will be described in greater detail with reference to FIG. 2, and may be positioned so that a detached end 2 of the transfer board 4 rests on a suitably placed wheelchair, as shown in FIG. 1. The transfer board 4 may also be positioned in other useful positions that will be described in greater detail with reference to FIGS. 5 and 6.

In various embodiments, the transfer board 4 is a generally planar board that may be made of a variety of materials that provide strength, durability, and a slidable surface, including but not limited to, wood, laminated wood, plastic, metal, fiberglass, and the like. The thickness of the transfer board 4 is such that it can support the weight of a person using the transfer board 4 and such that, as the transfer board 4 is supported on the base unit 10, the elevation of a top side of the transfer board 4 closely approximates the elevation of a seat of the toilet when the seat is in a down position. For example, in one preferred embodiment, the transfer board 4 may be approximately 15" long, 8½" wide, and ½ to ¾" thick.

Figure 5:
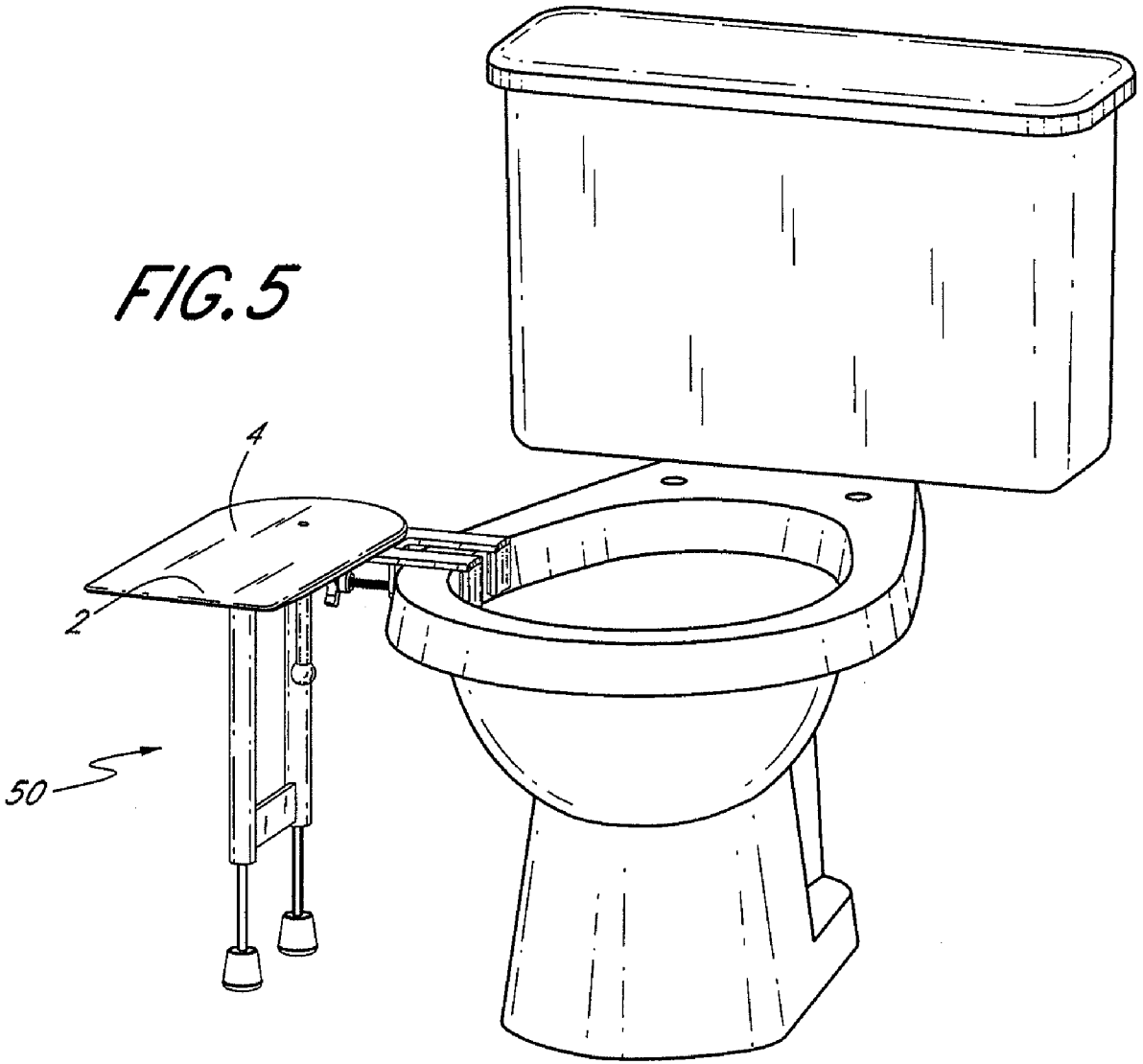
FIG. 5 depicts an embodiment of the toilet transfer system in a set-up configuration for allowing a wheelchair to be maneuvered into position for use.
Figure 6:
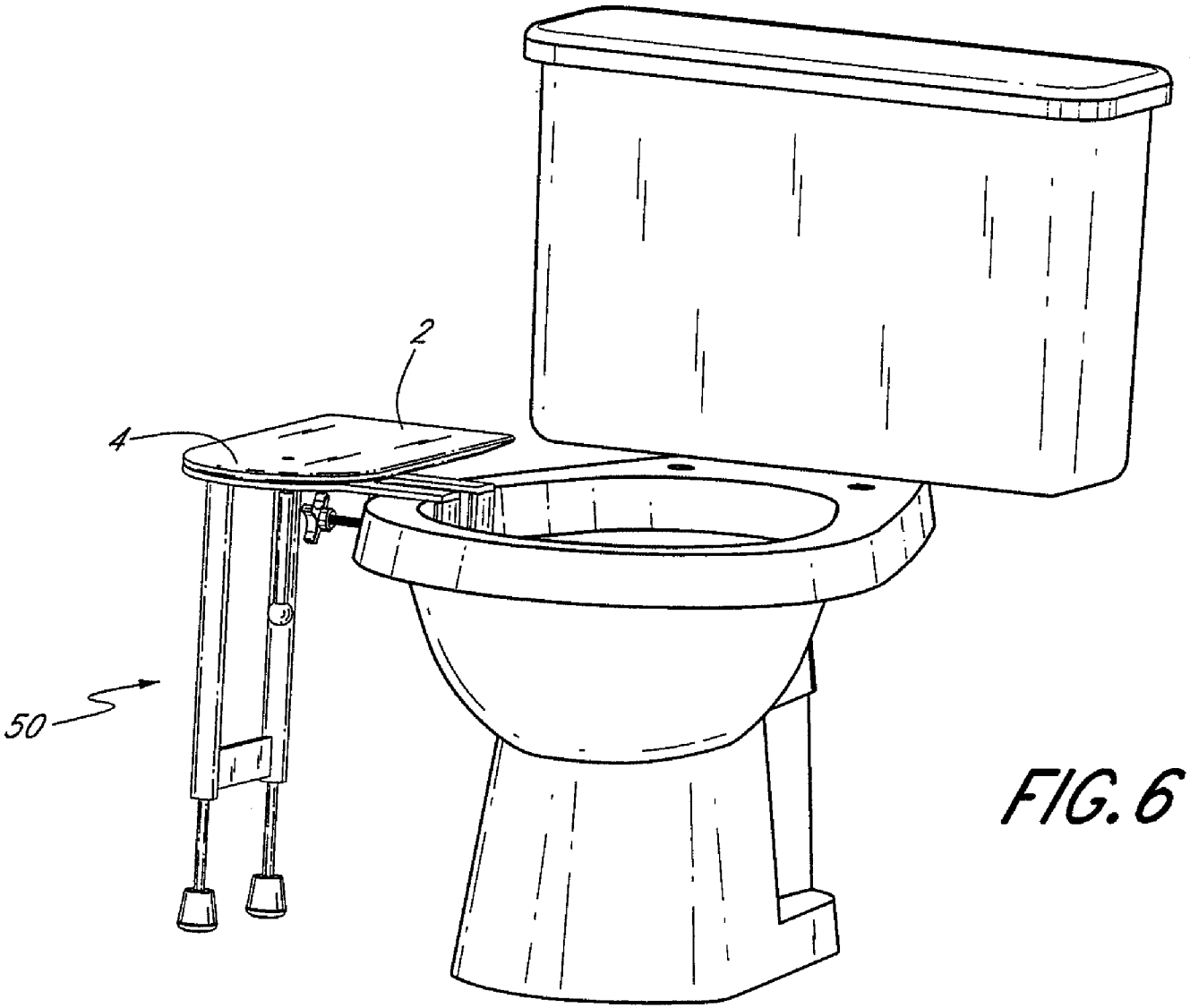
FIG. 6 depicts an embodiment of the toilet transfer system in a compact configuration for reduced-space storage between uses.

In a preferred embodiment, the coupled end 6 of the transfer board 4 is rotatably coupled to the base unit 10 such that the detached end 2 of the transfer board 4 may be freely rotated, when lying on a horizontal plane that is parallel to that of the base unit 10 or when pivoted at an angle with respect to the base unit 10, into a variety of positions along an arc of 360° with respect to the base unit 10. FIGS. 5 and 6 depict the transfer board 4 rotated into two different positions. In other embodiments, rotation of the transfer board 4 may be limited to an arc of less than 360° about one or more axes. In still other embodiments, the transfer board 4 may be rotatable into any of a set of predetermined positions. One example of a suitable coupling mechanism is described in greater detail with reference to FIG. 4.

As depicted in FIG. 1, in a preferred embodiment, a bottom side of the transfer board 4 is flat. At the detached end 2, a top side of the transfer board 4 is beveled, thereby allowing the detached end 2 of the transfer board 4 to rest on a seat of a wheelchair and to more easily slide under the hip or thigh of a person sitting in the wheelchair. For example, in one embodiment, the transfer board is approximately 0.6" thick at the coupled end 6 and approximately 0.2" thick at the beveled detached end 2.

Toilet bowl heights are frequently in the range of 15½"-19½", while wheelchair seat heights are frequently in the range of 18-20½" high. Thus, a differential of up to several inches may frequently exist between the height of the wheelchair seat and the height of the toilet rim. In addition, a long-term wheelchair user frequently uses a gel cushion or other type of cushion in the wheelchair seat, for added comfort. Such a cushion adds height, for example 2-5" of height, to the wheelchair seat, which may increase the height differential between the rim of the toilet that supports the coupled end 6 of the transfer board 4 and an effective level of the wheelchair seat at which the detached end 2 of the transfer board 4 is supported. Furthermore, wheelchairs come in a variety of seat heights, as do toilets, and it is thus preferable that the toilet transfer system be adapted to accommodate a variety of height differentials.

A coupling mechanism that securely allows for such a variety of height differentials without putting undue pressure on the toilet bowl rim is preferred for the toilet transfer system described herein. The coupling mechanism described with reference to FIG. 4 advantageously provides these features.

Figure 2:
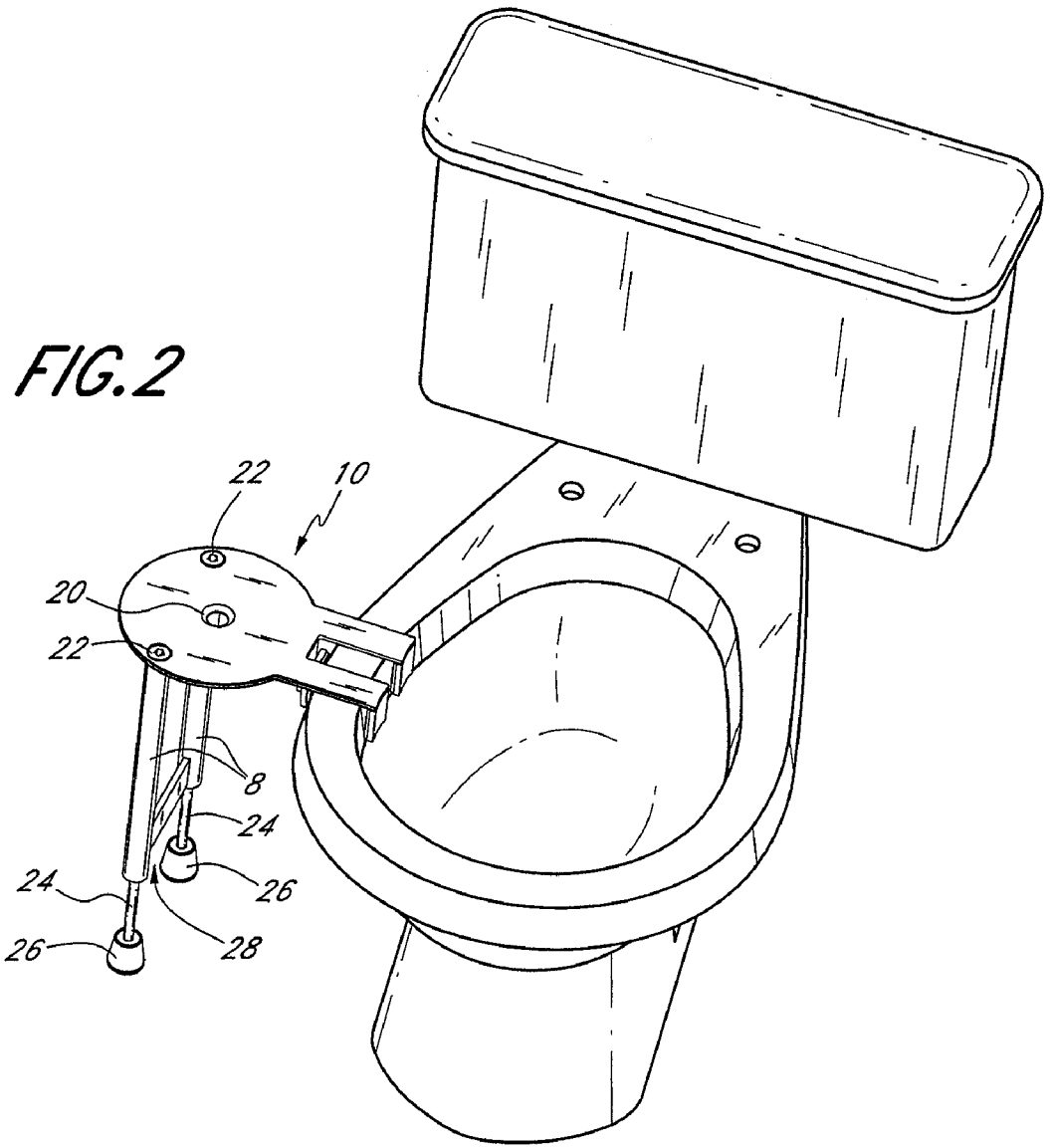
FIG. 2 depicts one embodiment of a base unit attached to a toilet bowl as viewed from above.

FIG. 2 depicts one embodiment of a base unit 10 attached to a toilet bowl as viewed from above. For ease of viewing, the toilet seat, wheelchair, and transfer board 4 are not shown in FIG. 2.

In the embodiment shown, the base unit 10 clamps onto the rim of the toilet with a clamping mechanism that will be described in greater detail with reference to FIG. 3. The base unit 10 comprises a beveled coupler-receiving hole 20 for accommodating the coupling system that couples the transfer board 4 to the base unit 10 and that will be described in greater detail with reference to FIG. 4. In a preferred embodiment, the coupler-receiving hole 20 extends through the base unit 10 such that the diameter of the coupler-receiving hole 20 on a top side of the base unit 10 is larger than the diameter of the coupler-receiving hole 20 on an underside of the base unit 10, thus forming a hole 20 that tapers in towards the bottom. For example, in one embodiment, the coupler-receiving hole 20 is approximately 1.3" in diameter on the top side of the base unit 10 and 0.8" in diameter on the underside of the base unit 10. This preferred tapered shaping of the coupler-receiving hole 20 will be described in greater detail with reference to the coupling system depicted in FIG. 4.

The base unit 10 also comprises two holes 22 for accommodating screws or other fastening mechanisms that allow the legs 8 to be removably attached to the base unit 10. The legs 8 may thus be separated from the base unit 10 for compact and easy transport of the toilet transfer system.

In a first preferred embodiment, the toilet transfer system comprises two adjustable-height legs 8. In a second preferred embodiment (not shown), the toilet transfer system comprises three adjustable-height legs 8. However, it will be readily understood by one of skill in the art that embodiments of the toilet transfer system may be configured to comprise one adjustable-height leg 8 or another number of adjustable-height legs 8. In some embodiments, additional stability for the legs 8 may be provided, as depicted in FIG. 2, by a supporting crossbar 28 that joins the legs 8.

The one or more legs 8 may be adjusted to allow the base unit 10 to be supported at a height that is substantially level with a rim of the toilet. The legs 8 may be adjustable using any of variety of adjustment mechanisms. In the embodiment shown in FIG. 1, each leg 8 comprises an extender rod 24 that is adapted to screw into and out of a bottom of an upper portion of the leg 8 and that may be tightened at a desired height. In the embodiment shown, each extender rod 24 is fitted with a rubber foot 26 that protects the floor on which it rests and that provides traction to assist in keeping the unit stable on a floor that may be slick.

In other embodiments, other adjustment mechanisms may be used for adjusting the height and/or angle of the legs 8, including, but not limited to a "twist-extend-lock" style mechanism or a "spring-button-lock" style mechanism.

Furthermore, in other embodiments, the base unit 10 may be supported by legs 8 that are of suitable fixed height. In still other embodiments, the base 10 may be supported by another method, such as by a system of diagonals (not shown) that are supported by a base portion of the toilet.

Figure 3:
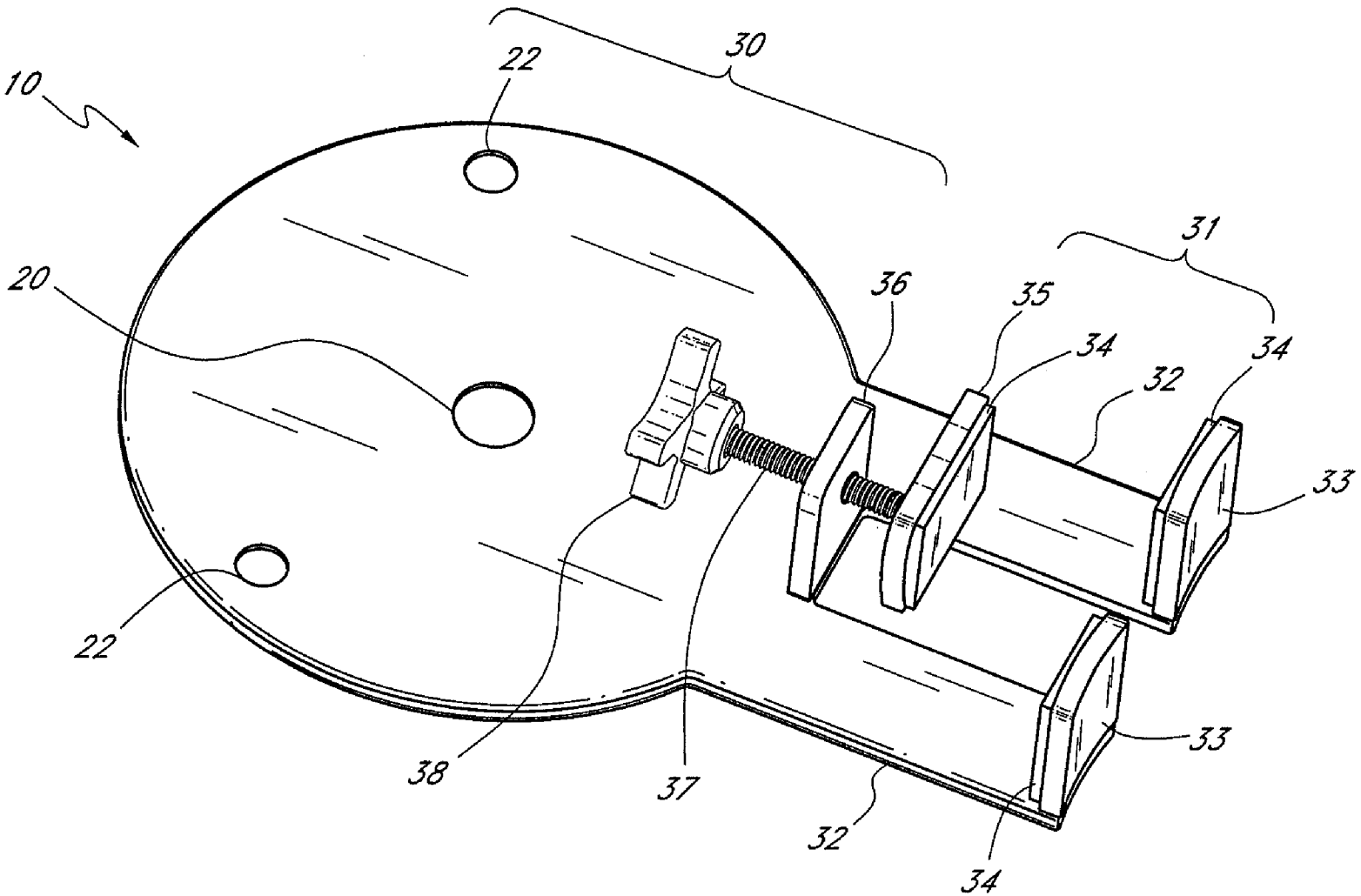
FIG. 3 depicts an underside of one embodiment of a base unit.

In still other embodiments (not shown), the base unit 10 is supported, without legs 8, by the toilet and by an embodiment of the clamping mechanism, such as the one described in FIG. 3, that allows the transfer board 4 to remain balanced thereupon parallel to the floor, even without further support by the wheelchair.

FIG. 3 depicts an underside of one embodiment of a base unit 10. In one embodiment, the base unit 10 is formed of a metal alloy plate that is ¼" in thickness. In other embodiments, the base unit 10 is formed of another material that provides strength and durability.

The base unit 10 includes a platform portion 30 and a bracket portion 31. The platform portion 30, as depicted in FIG. 3, is substantially planar and, in a preferred embodiment, is round in shape and approximately 8" in diameter. In other embodiments, the platform portion may be otherwise shaped. The coupler-receiving hole 20 may be seen in the center of the platform portion 30, as well as the holes 22 for screwing the legs 8 to the base unit 10.

In a preferred embodiment, the coupled end 6 of the transfer board 4 is semi-circular in shape, such that the rounded edge of the transfer board 4 matches or extends slightly beyond the circumference of the base unit 10, even if the transfer board 4 is rotated to position the detached end 2 of the transfer board in a variety of positions. In other embodiments, the coupled end 6 of the transfer board 4 may be shaped into another suitable shape.

The bracket portion 31 of the base unit 10 is configured to rest on the rim of the toilet bowl. In the embodiment depicted in FIG. 3, the bracket portion 31 comprises two support arm portions 32 that may be supported on the toilet bowl. Two fixed support plates 33 extend downward from the support arm portions 32 into the toilet bowl and are configured to be in contact with an inner wall of the toilet bowl when the base unit 10 is attached to the toilet. In one embodiment, each support arm 32 is approximately 4.2" by 1½" by ¼ in size, and each fixed support plate 33 is approximately 1½" by 1¼" by ¼" in size.

In other embodiments, the bracket portion 31 may comprise a single support arm 32 and/or a single fixed support plate 33, or another number of support arms 32 and/or fixed support plates 33.

In preferred embodiments, the support arms 32 are sufficiently thin to fit between the rim of the toilet bowl and the toilet seat in a down position without interfering with either the functionality or comfortable use of the toilet seat.

A compression screw support plate 36 extends from the underside of the base unit 10, preferably between the platform portion 30 and the bracket portion 31. In the embodiment depicted in FIG. 3, the compression screw support plate 36 is substantially planar and rectangular in shape, with a hole for accommodating a compression screw 37. The compression screw support plate 36 may be connected to the underside of the platform portion 30 using welding, or another fastening mechanism, such as nails or screws, or the compression screw support plate 36 may be formed integrally with the base unit 10, such as in a molding process.

A compression screw 37 extends through the threaded hold in the compression screw support plate 36, such that a handle portion 38 of the compression screw 37 is on a side nearer to the coupler-receiving hole 20. A movable support plate 35 is attached to the compression screw 37 and can be moved closer to or further from the fixed support plates 33 by rotating the handle portion 38 of the compression screw 37. When in use, the movable support plate 35 may thus be positioned to come into firm contact with an outer portion of the toilet bowl. Compressing the fixed support plates 33 and the movable support plate 35 firmly against the toilet, the base unit 10 may thus be secured to the toilet. Conversely, rotating the handle portion 38 of the compression screw 37 in an opposite direction causes the movable support plate 35 to be retracted from the toilet bowl, allowing the base unit 10 to be released from the toilet.

As depicted in FIG. 3, in a preferred embodiment, a non-slip semi-soft rubber material 34 may be attached to portions of the fixed support plates 33 and the movable support plate 35 that contact the toilet bowl in order to protect the toilet bowl from being scratched and to allow for better gripping of the toilet bowl by the fixed support plates 33 and the movable support plate 35.

The clamping mechanism described herein advantageously supports the base unit 10 on the toilet in a secure and compact manner. However, in other embodiments, a different type of clamping mechanism may be used to support the base unit 10 on the toilet without departing from the toilet transfer system as described and claimed herein.

Figure 4:
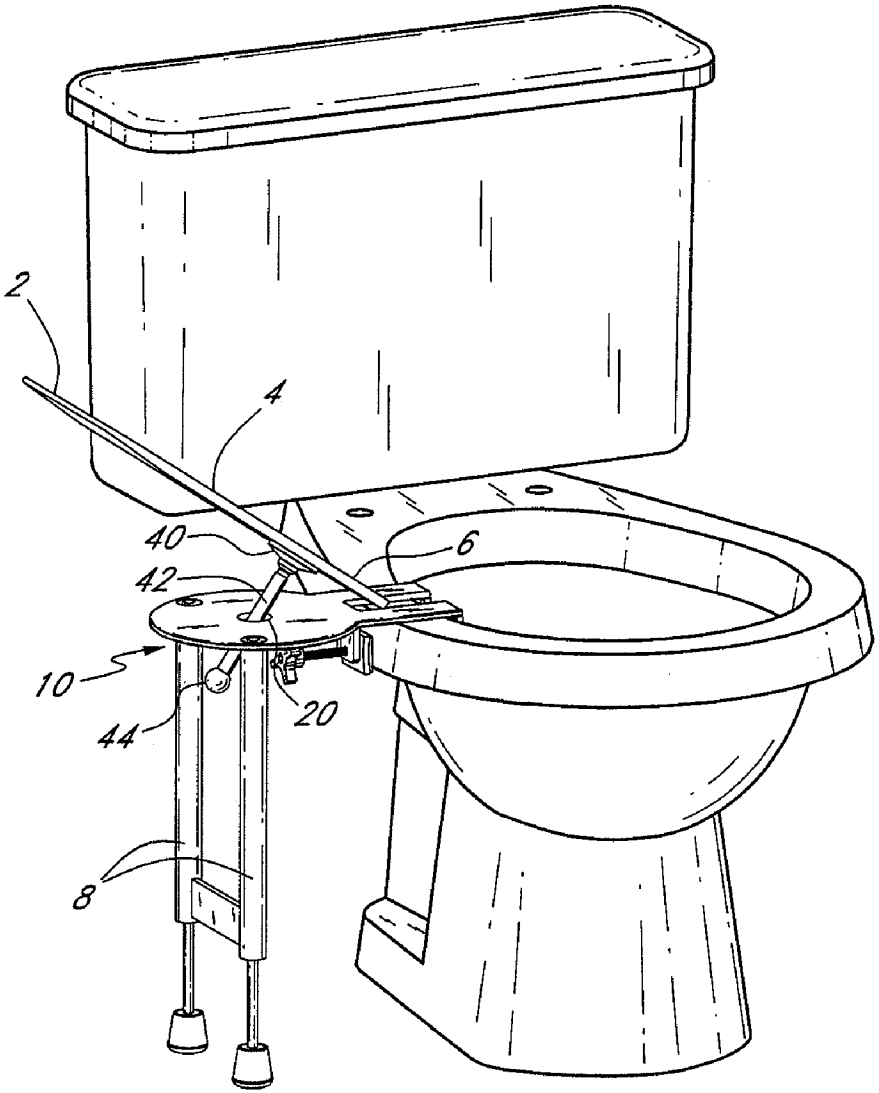
FIG. 4 depicts an embodiment of the toilet transfer system with the transfer board lifted at an angle to reveal the coupling system.

FIG. 4 depicts an embodiment of the toilet transfer system with the transfer board 4 lifted at an angle to reveal the coupling system. As depicted in FIG. 4, the coupling system comprises a swivel leveling mount 40 and a guide post 42 that are attached to an underside of the transfer board 4. A cylindrical guide post 42 is rotatably connected at a first end to the swivel leveling mount 40 by a ball joint. An end cap 44 that is wider in diameter than the coupler-receiving hole 20 may be screwed onto or off of a second end of the guide post 42. Thus, when the end cap 44 is removed from the guide post 42, the second end of the guide post 42 may be inserted through and/or withdrawn from the coupler-receiving hole 20 of the base unit 10. When inserted, screwing or otherwise attaching the end cap 44 onto the guide post 42 prevents the guide post 42 from being withdrawn from the coupler-receiving hole 20, thereby effectively coupling the transfer board 4 and the base unit 10.

In various embodiments, the guide post 42 is of sufficient length and is sufficiently rotatable with respect to the ball joint to provide the transfer board 4 with a range of movement relative to the base unit 10 that allows it to accommodate a wide variety of height differentials between toilet and wheelchair, as well as accommodating angular or other changes in position that may occur, for example, as a result of weight shifts as the person transfers from the wheelchair to the toilet or vice versa. For example, in one embodiment, the guide post 42 is approximately 4" in length.

Furthermore, in embodiments where the coupler-receiving hole 20 is tapered, as described with reference to FIG. 2, the sides of the coupler-receiving hole 20 help to guide the guide post 42, and thus the transfer board 4, back into a seated position, aligned with the base unit 10, if the transfer board 4 becomes misaligned from the base unit 10 during use.

Operation

FIG. 5 depicts an embodiment of the toilet transfer system in a set-up configuration, which is convenient for allowing a wheelchair to be maneuvered into position for use. As described above, once the toilet transfer system 50 has been attached to the toilet and the transfer board 4 coupled to the base unit 10, the transfer board 4 may be rotated into a variety of positions, for example, in a complete arc of 360° with respect to the base unit 10, while still being supported parallel to the floor by the base unit 10.

As depicted in FIG. 5, the transfer board 4 may be rotated so that the detached end 2 of the transfer board 4 faces in the same direction as the toilet. In this position, the toilet transfer system 50 takes up space to the side of the toilet amounting to approximately the width of the transfer board 4, for example 8" in one embodiment. Thus, this compact configuration allows maneuvering room for backing the wheelchair alongside and close to the toilet, even in a bathroom with restricted space to the side of the toilet.

Once the wheelchair is positioned parallel to and facing in the same direction as the toilet, the transfer board 4 may be rotated so that the detached end 2 of the transfer board 4 points towards the person in the wheelchair, as depicted in FIG. 1. The detached, preferably beveled, end 2 may be slid under the thigh or hip of the person, and the person may use the board 4, either assisted or unassisted, to transfer to and from the toilet.

FIG. 6 depicts an embodiment of the toilet transfer system 50 in a compact configuration that is convenient for reduced-space storage between uses. Once the toilet transfer system 50 is no longer being used and the wheelchair is no longer alongside the toilet, the transfer board 4 may be rotated so that the detached end 2 points towards the back of the toilet. In this position, the toilet transfer system 50 takes up space to the side of the toilet approximately equal to only the width of the transfer board 4, without extending forward of the toilet, thus further diminishing the usable floor space taken up by the toilet transfer system 50 while it remains installed on the toilet.

In this position, the toilet seat may be lowered onto the support arms 32 of the base unit 10 (not shown) into a normal or near-normal position, and thus the presence of the toilet transfer system 50 alongside the toilet need not impede normal use of the toilet.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. While certain embodiments of the inventions have been described, these embodiments have been presented by way of example only, and are not intended to limit the scope of the inventions. Indeed, the novel methods and systems described herein may be embodied in a variety of other forms without departing from the spirit thereof. For example, a non-portable embodiment of the toilet transfer system 50 may be designed for permanent use at a single location. Various embodiments of the clamping mechanism and the coupling mechanism may be used, as well as other shapes of the base unit 10, legs 8, and/or transfer board 4. Additionally, other embodiments of the toilet transfer system may comprise a carrying case for transport of the system. The accompanying claims, as now presented and as may be amended or otherwise supplemented in the future, are intended to cover such forms or modifications as would fall within the scope and spirit of the invention.

What is claimed is:

1. An apparatus for facilitating the transfer of a person between a wheelchair and a toilet, the apparatus comprising:

a. a base unit which is separate from a wheelchair, the base unit being adapted to be located between the wheelchair and a rim of the toilet, the base unit comprising a combination platform portion and bracket portion, the bracket portion adapted to secure the base unit to the rim of the toilet, the platform portion extending from the bracket portion in a direction toward the wheelchair;

b. at least one leg secured to the base unit, the leg having a bottom end adapted to rest upon a floor surface; and c. a transfer board coupled to the platform portion, the transfer board having a first end that rests upon the combination platform portion and bracket portion, the transfer board further having a second end that does not rest on the combination platform portion and bracket portion, wherein the second end rests on the wheelchair.

2. The apparatus of claim 1 wherein the transfer board is coupled to the platform portion by a coupling system that enables the transfer board to both swivel about the platform portion and to be raised at an angle relative to the platform portion.

3. The apparatus of claim 2, the coupling system comprising a coupler-receiving hole in the platform portion and a guide post having a first end connected to an underside of the transfer board, the guide post being inserted through the coupler-receiving hole.

4. The apparatus of claim 3, wherein the first end of the guide post is rotatably connected to the underside of the transfer board by a combination swivel leveling mount and ball joint.

5. The apparatus of claim 4, wherein the guide post has a second end comprising a removably securable end cap, the end cap adapted to prevent complete removal of the guide post from the coupler-receiving hole.

6. The apparatus of claim 1 wherein the at least one leg is height-adjustable.

7. The apparatus of claim 1, wherein the bracket portion is adapted to rest on and extend over the rim of the toilet, the bracket portion comprising a first support plate extending downward from an end of the bracket portion, the first support plate adapted to be in contact with an inner wall of the toilet when the base unit is secured to the toilet, the bracket portion further comprising a second support plate located below the base unit and opposite at least a portion of the first support plate, the second support plate adapted to be in contact with an outer wall of the toilet when the base unit is secured to the toilet.

8. The apparatus of claim 7, wherein the first support plate is fixed and the second support plate is movable closer to and further from the first support plate.

9. The apparatus of claim 8, wherein a compression screw support plate extends from an underside of the base unit, the compression screw support plate having a threaded hole through which a compression screw extends, the compression screw having a first end that is distal from the first support plate and a second end that is proximal to the first support plate, wherein a handle is attached to the first end of the compression screw and the second support plate is attached to the second end of the compression screw, the second support plate being movable by rotation of the compression screw.

10. A toilet transfer system comprising:

a. a wheelchair;

b. a toilet;

c. a base unit which is separate from the wheelchair, the base unit being located between the wheelchair and a rim of the toilet, the base unit comprising a combination platform portion and bracket portion, the bracket portion securing the base unit to the rim of the toilet;

d. at least one leg secured to the base unit, the leg having a bottom end that rests upon a floor surface; and e. a transfer board coupled to the platform portion, the transfer board having a first end that rests upon the combination platform portion and bracket portion, the transfer board further having a second end that rests on the wheelchair.

11. The toilet transfer system of claim 10 wherein the transfer board is coupled to the platform portion by a coupling system that enables the transfer board to both swivel about the platform portion and to be raised at an angle relative to the platform portion, the coupling system comprising a coupler-receiving hole in the platform portion and a guide post having a first end connected to an underside of the transfer board, the guide post being inserted through the coupler-receiving hole.

12. The toilet transfer system of claim 11, wherein the first end of the guide post is rotatably connected to the underside of the transfer board by a combination swivel leveling mount and ball joint, the guide post having a second end comprising a removably securable end cap, the end cap adapted to prevent complete removal of the guide post from the coupler-receiving hole.

13. The toilet transfer system of claim 10 wherein the at least one leg is height-adjustable.

14. The toilet transfer system of claim 10, wherein the bracket portion is adapted to rest on and extend over the rim of the toilet, the bracket portion comprising a first support plate extending downward from an end of the bracket portion, the first support plate adapted to be in contact with an inner wall of the toilet when the base unit is secured to the toilet, the bracket portion further comprising a second support plate located below the base unit and opposite at least a portion of the first support plate, the second support plate adapted to be in contact with an outer wall of the toilet when the base unit is secured to the toilet.

15. The toilet transfer system of claim 14, wherein the first support plate is fixed and the second support plate is movable closer to and further from the first support plate.

16. The toilet transfer system of claim 15, wherein a compression screw support plate extends from an underside of the base unit, the compression screw support plate having a threaded hole through which a compression screw extends, the compression screw having a first end that is distal from the first support plate and a second end that is proximal to the first support plate, wherein a handle is attached to the first end of the compression screw and the second support plate is attached to the second end of the compression screw, the second support plate being movable by rotation of the compression screw.

17. The toilet transfer system of claim 15, the toilet further comprising a toilet seat adapted to rest upon the rim of the toilet when the toilet seat is in a down position, there being a gap between a portion of the toilet seat and the rim of the toilet when the toilet seat is in the down position, wherein the bracket portion rests on and extends over the rim of the toilet within the gap between the portion of the toilet seat and the rim of the toilet such that the bracket portion does not interfere with the ability of the toilet seat to be in the down position.

18. An apparatus for facilitating the transfer of a person between a wheelchair and a toilet, the apparatus comprising:

a. a base unit adapted to be located between the wheelchair and a rim of the toilet, the base unit comprising a combination platform portion and bracket portion, the bracket portion adapted to secure the base unit to the rim of the toilet wherein the bracket portion is adapted to rest on and extend over the rim of the toilet, the bracket portion comprising a first support plate extending downward from an end of the bracket portion, the first support plate adapted to be in contact with an inner wall of the toilet when the base unit is secured to the toilet, the bracket portion further comprising a second support plate located below the base unit and opposite at least a portion of the first support plate, the second support plate adapted to be in contact with an outer wall of the toilet when the base unit is secured to the toilet, wherein the first support plate is fixed and the second support plate is movable closer to and further from the first support plate;

b. at least one height-adjustable leg secured to the base unit, the leg having a bottom end adapted to rest upon a floor surface; and c. a transfer board coupled to the platform portion, the transfer board having a first end that rests upon the combination platform portion and bracket portion, the transfer board further having a second end that is adapted to rest on the wheelchair, wherein the transfer board is coupled to the platform portion by a coupling system that enables the transfer board to both swivel about the platform portion and to be raised at an angle relative to the platform portion, the coupling system comprising a coupler-receiving hole in the platform portion and a guide post having a first end connected to an underside of the transfer board, the guide post being inserted through the coupler-receiving hole.

19. The apparatus of claim 18, wherein a compression screw support plate extends from an underside of the base unit, the compression screw support plate having a threaded hole through which a compression screw extends, the compression screw having a first end that is distal from the first support plate and a second end that is proximal to the first support plate, wherein a handle is attached to the first end of the compression screw and the second support plate is attached to the second end of the compression screw, the second support plate being movable by rotation of the compression screw, and wherein the first end of the guide post is rotatably connected to the underside of the transfer board by a combination swivel leveling mount and ball joint, wherein the guide post has a second end comprising a removably securable end cap, the end cap adapted to prevent complete removal of the guide post from the coupler-receiving hole.

20. The apparatus of claim 19 comprising at least two height-adjustable legs secured to the base unit, the at least two height-adjustable legs respectively having bottom ends adapted to rest upon a floor surface, wherein the first end of the transfer board has a perimeter that is rounded in shape.

* * * * *